US005871209A

United States Patent [19]

Orchard et al.

[11] Patent Number: 5,871,209

[45] Date of Patent: Feb. 16, 1999

[54] CASSETTE BASED DOCUMENT HANDLING SYSTEM

[75] Inventors: Anthony G. Orchard, Dallas; Charles L. Bradford, Garland; Mark A. Carrion, Plano; James Lacy Vanderpool, Colleyville, all of Tex.

[73] Assignee: Currency Systems International, Inc., Irving, Tex.

[21] Appl. No.: 609,170

[22] Filed: Mar. 1, 1996

[51] Int. Cl.[6] ..... B65H 1/02

[52] U.S. Cl. ..... 271/149; 271/162; 414/411; 414/417

[58] Field of Search ..... 271/149, 162; 209/534, 552, 584, 900, 933, 934; 414/411, 417

[56] References Cited

U.S. PATENT DOCUMENTS

| | | | |
|---|---|---|---|
| 4,275,667 | 6/1981 | Hilton | 109/44 |
| 4,283,097 | 8/1981 | Lundblad | 312/223 |
| 4,337,393 | 6/1982 | Hilton | 235/487 |
| 4,363,279 | 12/1982 | Johansson | 109/29 |
| 4,427,192 | 1/1984 | Kushmaul et al. | 271/11 |
| 4,438,704 | 3/1984 | Hutcheon | 109/44 |
| 4,447,097 | 5/1984 | Lafevers et al. | 271/149 X |
| 4,459,052 | 7/1984 | Lundblad | 271/9 X |
| 4,494,743 | 1/1985 | Kushmaul et al. | 271/11 |
| 4,501,416 | 2/1985 | Hain | 271/3.1 |
| 4,516,899 | 5/1985 | Wood et al. | 414/330 |
| 4,529,118 | 7/1985 | Granzow et al. | 232/43.3 |
| 4,529,119 | 7/1985 | Granzow et al. | 232/43.3 |
| 4,560,155 | 12/1985 | Hosking et al. | 271/11 |
| 4,570,548 | 2/1986 | Martin et al. | 109/66 |
| 4,580,422 | 4/1986 | Wills | 70/63 |
| 4,593,895 | 6/1986 | Myers et al. | 271/148 |
| 4,597,340 | 7/1986 | Huckle | 221/227 X |
| 4,603,847 | 8/1986 | Oota et al. | 271/119 X |
| 4,655,368 | 4/1987 | Bateman et al. | 221/4 |
| 4,655,391 | 4/1987 | Granzow et al. | 232/43.1 |
| 4,659,008 | 4/1987 | Howett et al. | 109/43 X |
| 4,662,621 | 5/1987 | Lundblad | 271/3 |
| 4,670,643 | 6/1987 | Hain et al. | 235/379 |
| 4,704,061 | 11/1987 | Peebles | 414/405 |
| 4,714,029 | 12/1987 | Idegren et al. | 109/45 |
| 4,725,823 | 2/1988 | Persson | 340/571 |
| 4,736,852 | 4/1988 | Edin et al. | 209/534 |
| 4,759,447 | 7/1988 | Lundblad et al. | 209/534 |
| 4,813,658 | 3/1989 | Hosking et al. | 271/10 |
| 4,816,652 | 3/1989 | Wildgoose et al. | 235/379 |
| 4,890,766 | 1/1990 | Martin et al. | 221/198 |
| 4,977,583 | 12/1990 | Gorgone | 209/534 X |
| 4,992,648 | 2/1991 | Hutchison | 235/379 |
| 4,997,128 | 3/1991 | Suris | 232/16 |
| 5,012,075 | 4/1991 | Hutchison et al. | 235/379 |
| 5,053,748 | 10/1991 | Stern | 340/541 |

(List continued on next page.)

FOREIGN PATENT DOCUMENTS

| | | | |
|---|---|---|---|
| 144022 | 8/1983 | Japan | 414/417 |
| 4016829 | 8/1994 | WIPO | 209/584 |

*Primary Examiner*—Tuan N. Nguyen
*Attorney, Agent, or Firm*—Gregory M. Howison; Mark W. Handley

[57] ABSTRACT

A cassette (20) for a currency handling system includes a door (28) that can be opened to expose the entire front surface of the cassette. An end door (30) is operable to be opened to allow currency that is disposed within the interior of the cassette (20) to be urged outward. The cassette (20) has a locking mechanism disposed in an end (72), which locking mechanism prevents the door from opening until the cassette (20) is disposed in a docking station. Once in the docking station, a paddle (56) is urged downward into the cassette (20) to urge the notes outward therefrom. These notes are moved into a buffer region (58) and then the cassette (20) can be removed to allow another cassette (20) to be disposed therein. This allows a continuous feeding operation. The cassette (20) can then be disposed in a second collection docking station to collect the output of the sorter (41). In this docking station, a paddle (68) is reciprocated downward into the cassette (20) with the collected notes.

8 Claims, 6 Drawing Sheets

U.S. PATENT DOCUMENTS

| | | | |
|---|---|---|---|
| 5,071,032 | 12/1991 | Thornton et al. | 221/154 |
| 5,073,829 | 12/1991 | Katsuta et al. | 358/498 |
| 5,097,959 | 3/1992 | Tilles et al. | 271/3 X |
| 5,110,105 | 5/1992 | Nicoll et al. | 271/5 |
| 5,112,040 | 5/1992 | Johnston et al. | 271/11 |
| 5,209,395 | 5/1993 | Zouzoulas et al. | 232/15 |
| 5,222,626 | 6/1993 | Reinschmidt et al. | 221/197 |
| 5,251,738 | 10/1993 | Dabrowski | 271/181 X |
| 5,271,613 | 12/1993 | Hain | 271/3.1 |
| 5,288,066 | 2/1994 | Hain | 271/181 |
| 5,405,131 | 4/1995 | Zouzoulas | 271/181 |
| 5,411,249 | 5/1995 | Zouzoulas | 271/181 |
| 5,436,435 | 7/1995 | McMillan | 235/379 |
| 5,607,063 | 3/1997 | Nishijima et al. | 209/584 |

CASSETTE BASED DOCUMENT HANDLING SYSTEM

TECHNICAL FIELD OF THE INVENTION

The present invention pertains in general to a document handling system and, more particularly, to a currency handling system that utilizes a cassette for transporting currency between stations.

BACKGROUND OF THE INVENTION

After currency is distributed in the public sector, it will typically find its way back into the banking institutions. This is facilitated through individuals depositing currency documents in their local banking institutions, and businesses forwarding their cash receipts to the banking institutions. Once the banking institutions have received the currency in the form of the notes, these notes must then be processed. Although the processing can be facilitated by hand, this is somewhat tedious. To facilitate the large number of notes that must be sorted, counted and then re-bundled or "strapped" for distribution back to the banks, large high speed currency sorting machines have been developed.

Currency sorting machines typically have a feeder slot into which stacks of currency in different denominations and even different sizes can be placed. The currency sorter will then individually strip the notes or documents from the feeder slot, pass them through various sensing stations to determine the denomination of the note and even the quality or integrity of the note. Once this is done, then the sorting machine will deposit the note in a collection slot associated with the proper denomination. Typically, a separate collection slot is provided for notes that are defective due to, for example, a tear or excessive wear. These sorting machines can sort notes at rates up to 2,000 notes per minute.

The disadvantage to present sorting systems is the manner in which the notes must be transported between stations. Typically, there are three stations, the first being the initial hand sorting or collection operation at the original banking institution, the second being the feeder operation to the sorter and the third being the collection operation at the sorter. Due to the high speed nature of the sorter, the sorter typically outstrips the speed at which the documents can be placed into the sorter and then removed from the sorter. Therefore, there exists a need for a system that will facilitate an increase in the throughput.

SUMMARY OF THE INVENTION

The present invention disclosed and claimed herein comprises a method and apparatus for transferring documents utilizing a portable cassette having a cover that can be opened to expose the documents or closed in a secured and locked manner to prevent access to documents contained therein. The cassette is loaded at a first station in an open configuration to provide a stack of documents therein, and, after loading, the cassette is locked. The loaded cassette is then transported to a second location in the locked configuration, and then disposed in an unloading docking station.

The loaded cassette is opened to expose at least one end of the stack, and then the stack of documents in the loaded cassette is urged out of the loaded cassette through the at least one end into a buffer region that is continually moving. This allows the contents of the cassette to become part of the documents in the buffer region. The cassette is removed after urging the documents therefrom and after the documents have cleared the at least one end. The unloading operation is then continuously repeated with a new loaded cassette.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
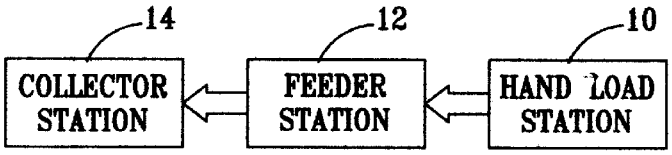
FIG. 1 illustrates an overall block diagram of the process flow from the hand loading station to the collection station.

Referring now to FIG. 1, there is illustrated a diagrammatic view of the process flow for a document handling system of the present invention, which utilizes a cassette for transporting currency. The process flow is provided by three stations, a hand load station 10, a feeder station 12 and a collection station 14. Initially, as will be described in more detail hereinbelow, currency is hand loaded into a cassette. Typically, the cassettes are delivered to a banking institution in an open configuration, there being a locking system that allows the cassette to be placed into a closed and secure configuration. These cassettes are stacked in a compact manner such that an operator can remove the open cassette from the stack, place it on what is referred to as a "desktop station" and then proceed to load the currency therein. Typically, the currency is counted at the banking institution by hand, placed in some type of bundle and then disposed in the cassette. There may be some type of separator card with a bar code disposed thereon which can be utilized at the central banking institution for identification. Once the currency is hand loaded into the cassette, the cassette is then closed and placed in a secure configuration. Once it is in this configuration, it cannot be opened until it is placed onto another docking station that has a key system for unlocking the cassette.

After the cassettes are hand loaded and secured, they are then placed on some type of transport or given to an individual that has the responsibility for the transport. The loaded cassettes are then transported to a sorting facility. The sorting facility contains both the feeder station 12 and the collection station 14. Of course, the sorting facility may be in the next room from the hand loading station 10. At the feeder station 12, the loaded cassettes can be sequentially disposed in the feeder station to allow high speed feeding and high speed sorting. Further, as will be described hereinbelow, this is a continuous feeding operation.

In the continuous feeding operation, a cassette is retrieved from the transport mechanism or the stack and placed onto a docking station associated with the feeding station 12. When it is placed on the docking station, this action unlocks the cassette and allows the door for the cassette to be opened and providing access to the contents. Once access is obtained, then the operator configures the feeding station to urge the notes out of the cassettes and into a buffer region. Once all the bills are urged out of cassette and into the buffer region, the cassette can then be removed in an open position and then a new loaded and locked cassette placed therein and the procedure continues.

Once the cassette is placed into the feeder station 12, the bills that are accessed are placed behind the previous notes in the buffer region. Therefore, the interior of the cassette and the buffer region constitute a feeding supply to the sorting system. The urging of the notes out of the cassette is the same operation that urges the notes in the buffer region up into interface with the sorting mechanism. This is a constant operation with the notes continually urged upward into the sorting mechanism, such that when a new cassette is placed into the feeding mechanism, the previous notes are still in the buffer region to provide a "seamless" feeding operation. The notes are fed at approximately 1,500 notes per minute and a typical cassette will contain about 2,000 notes.

The sorting mechanism is operable to retrieve the notes from the feeding mechanism, evaluate those notes for the integrity of the notes, orientation and also the denomination of the notes. The notes are then "slotted" into different collection slots. The open cassettes are placed into a docking station in the collection slot, similar to the docking station in the feeder slot, and then the notes collected therein. Once the notes are collected, the cassette can then be locked and removed for subsequent processing.

Figure 2:
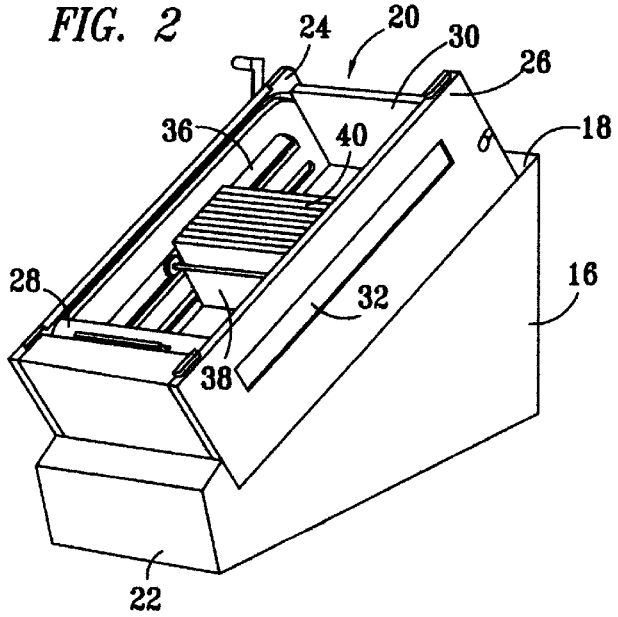
FIG. 2 illustrates a perspective view of a cassette disposed in a desktop station for initial loading of the cassettes.

Referring now to FIG. 2, there is illustrated a block diagram of desktop station 16 for use in the hand loading station 10. The desktop station 16 is a box that has a tilted receiving surface 18. The tilted receiving surface 18 is operable to receive a cassette 20 on the surface thereof The desktop station 16 has at the lower end of the surface 18 a tilting door 22, which door 22 is operable to cover a locking mechanism (not shown). The door 22 is spring loaded, such that when the cassette 20 is removed, the door 22 will swing closed to cover the locking mechanism. This provides both a protective cover and a technique to ensure that the cassette 20 will be placed on the surface 18 above the locking mechanism, such that it will be on the same plane as the locking mechanism before engaging the locking mechanism.

The cassette 20 is comprised of a left side 24 and a right side 26. A tambour door 28 is disposed on the cassette 20, such that it can be pulled over the top opening of the cassette 20. An end door 30 is provided on one end thereof which is operable to cover an end opening. Therefore, the door 28 can be slidingly moved over the top opening and a portion of the end opening and, in conjunction with the door 30, completely seal the cassette 20. A window 32 is provided on the right side 26 and a window 36 is provided on the left side 24, which windows 32 and 36 are operable to allow a user to view the interior contents thereof to determine if there are notes in the cassette 20 after locking. A sliding compression panel 38 is provided which slides along the length of the interior of the cassette 20 to allow notes 40 which are disposed between the compression panel 38 and the opening to be stacked tightly within the cassette 20. The operation of the cassette 20 and the interior workings thereof will be described in more detail hereinbelow.

In the operation of the desktop station 16, the cassette 20 is operable to the stored in a stacked configuration with other cassettes 20, all the cassettes 20 being in an open configuration in the preferred embodiment. When a user desires to fill one of the cassettes 20, the open cassette 20 is retrieved from its storage area and disposed on the desktop station 16. It is not necessary for the desktop station 16 to have an interfacing locking mechanism that is disposed under the door 22, but this is available and shown in this embodiment. The only purpose for the mechanism under the door 22 is to provide a key mechanism for unlocking the locking mechanism internal to the cassette 20. Again, this will be described in more detail hereinbelow.

The operator, after disposing the cassette 20 on the desktop station 16, then hand loads the notes 40 into the interior of the cassette between the compression panel 38 and the end opening of the cassette 20. Typically, the compression panel 38 can be moved toward the bottom or opposite end from the open end, to provide access to the full capacity of the cassette 20. Once the notes 40 are loaded into the cassette 20 to the desired capacity, which may be the full capacity, the compression panel 38 is moved toward the open end and the closed door 30 to "pack" the notes and the door 28 is then slidingly moved upward toward the end opening proximate the door 30, this motion then locking the cassette 20 if a corresponding key mechanism is not available, otherwise the cassette 20 must be removed from the desktop station 16 to lock the cassette 20. The cassette 20 is then removed from the desktop station 16 and disposed on a transport mechanism for transport to the next station, the feeder station 12.

Figure 3:
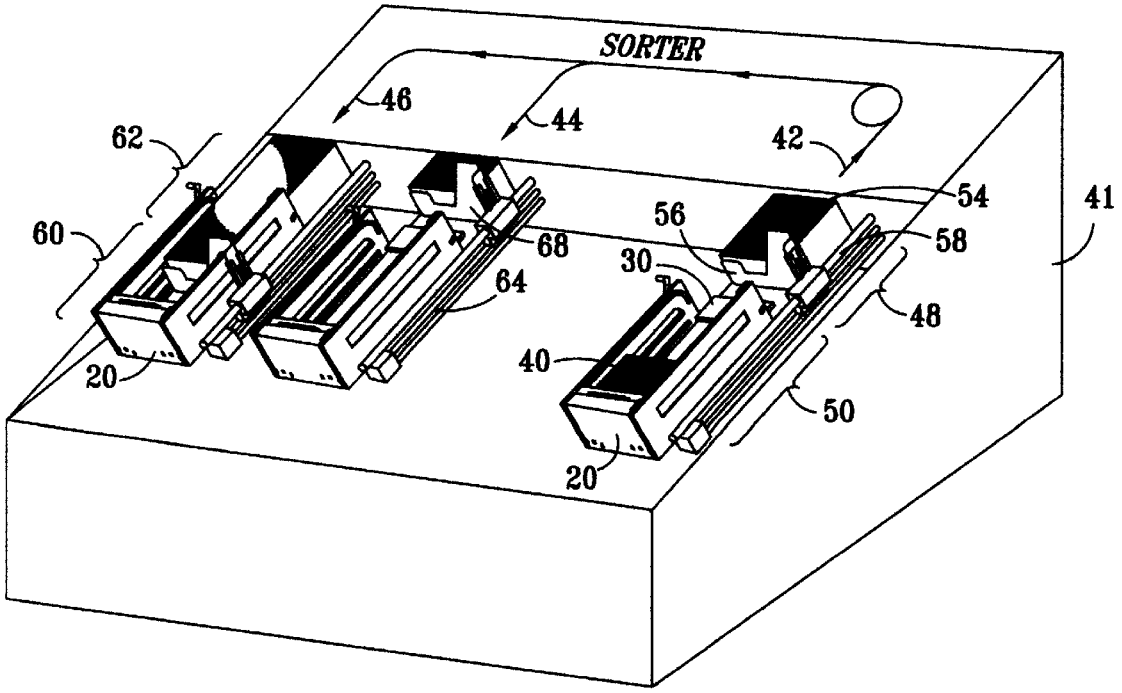
FIG. 3 illustrates the cassette disposed in a sorter, illustrating both the feeding operation and the collection operation.

Referring now to FIG. 3, there is illustrated a perspective view of a sorting mechanism 41, which FIG. 3 does not illustrate the details of the sorting mechanism 41. However, the sorting mechanism 41 is operable to retrieve documents, such as notes, from a point 42 and deliver them to one of two points 44 or 46, only two delivery points noted for simplicity purposes. The sorting mechanism 41 is conventional and known by those skilled in the art.

The sorting mechanism 41 has a feeder docking station for feeding notes to the point 42 and two collection docking stations for receiving notes delivered to the points 44 and 46, respectively. When the cassette 20 is transported from the desktop station 16, after locking thereof, the cassette 20 is then disposed in the feeder docking station, which is comprised of a buffer region 48 and a docking region 50. The docking region 50 has associated therewith a key mechanism, similar to the key mechanism disposed under the door 22 in the desktop station 16 of FIG. 2. It is operable to be disposed in the docking region 50 and the key mechanism engaged, such that the door 28 can now be slidingly moved down toward the unopen end of the cassette 20 to expose all of the notes therein. The door 30 is then opened to provide a flat surface to allow the notes 40 within the cassette 20 to be moved to the buffer region 48, the surface of the cassette 20, the surface of the door 30 and the lower surface of the buffer region 48 being coplanar.

It can be seen in the embodiment of FIG. 3 that there are a plurality of notes 54 that are disposed in the buffer region 48. These notes 54 are urged upward toward the point 42 with the use of a "paddle" 56. The paddle 56 is mounted on a feeding mechanism 58, which feeding mechanism 58 is operable to reciprocate the paddle along the length of the docking region 50 and buffer region 48. The paddle 56, as will be described in more detail hereinbelow, is operable to be reciprocated upward and moved down into the unopen end of the cassette 20 and then pushed down into the cassette 20. It is only necessary for the paddle 56 to rise up high enough to clear the sides of the cassette 20.

In operation, the embodiment of FIG. 3 is illustrated wherein the notes 54 and the buffer region were previously fed in from prior cassette 20. The paddle 56 therefore had cleared the prior cassette and is fully within the buffer region 48, continually urging the notes 54 upward to the point 42. This urging of the notes 54 upward to the point 42 allows the sorting mechanism to strip the notes off. This stripping operation operates at approximately 1,500 notes per minute. When the new cassette 20 is disposed within the docking region 50, the operator in one embodiment then urges the notes 40 upward against the back surface of the paddle 56 and then moves the paddle 56 out of contact with the notes 54 in the buffer region 48 and then moves it vertically upward from the surface of the feeder station and then urges it downward along the length of the feeder station toward the closed end of the cassette 20 until it is proximate to the bottom of the notes 40. The paddle 56 is then engaged with the bottom of the notes 40, such that the notes 40 and the notes 54 now comprise one stack of notes. The paddle 56 then automatically urges the entire combined stack of notes 40 and 54 upward to the point 42. As soon as sufficient notes have been stripped off the top of the combined stack and the combined stack clears the cassette 20, the cassette 20 can be removed and another cassette provided. During this removal, the cassette 20 is allowed to remain open.

In the next operation, the operator will proceed to the next station, the collection station. In this mode, the cassette 20 is disposed within one of the collection docking stations. Each of the collection docking stations has a buffer region 60 and a docking region 62. The buffer region 60 is typically smaller than the buffer region 48, approximately six inches, but it has a similar key device as the feeder docking station in the event that a closed cassette is disposed therein. Once disposed in the docking region 62, the door 30 is then opened to provide a flat surface. A feeding mechanism 64 is provided that runs along the length of both buffer region 60 and docking region 62 and has a paddle 68 associated therewith. The paddle 68 is operable to reciprocate downward from the associated one of the points 44–46 as notes are fed therein and will move downward into the associated cassette 20. Once the sorter has determined that the capacity of the cassette 20 has been reached, i.e., the desired note count, it will discontinue routing notes to that particular collection location. The user will then remove the cassette 20, close the door 28 and then store the notes. Typically, there will be some type of bar code for identification purposes on a particular cassette which can be entered into a computer to provide some type of tracking ability. A reader could be implemented for automatically reading the bar code as the cassette is disposed on its associated feeder docking station, collection docking station, or desktop station.

Figure 4:
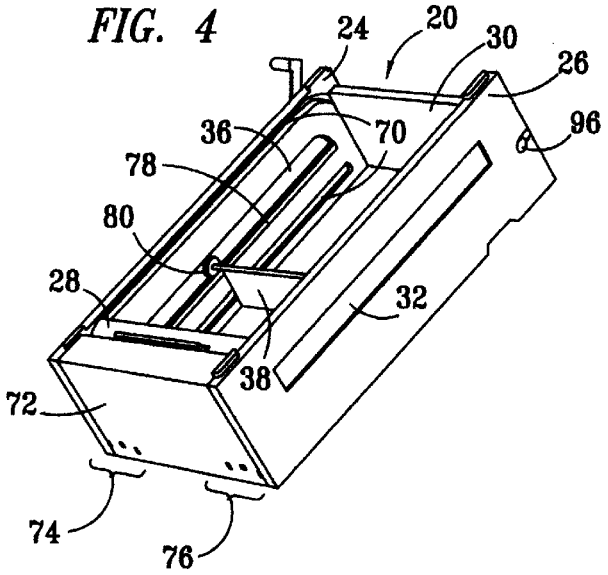
FIG. 4 illustrates a perspective view of the cassette.

Referring now to FIG. 4, there is illustrated a perspective view of the cassette 20 in the open position. Each of the sides 24 and 26 has disposed around the peripheral edges on the inner side thereof a slot 70 which is a guide slot for the door 28. An end cap 72 is provided to cover the locking mechanism (not shown) and has two groups of three key access holes 74 and 76. The end cap 72 covers the end portion of the door 28 also. However, one of its primary functions is to hide the key mechanism to prevent unlocking of the system and also to protect the locking mechanism.

Figure 5:
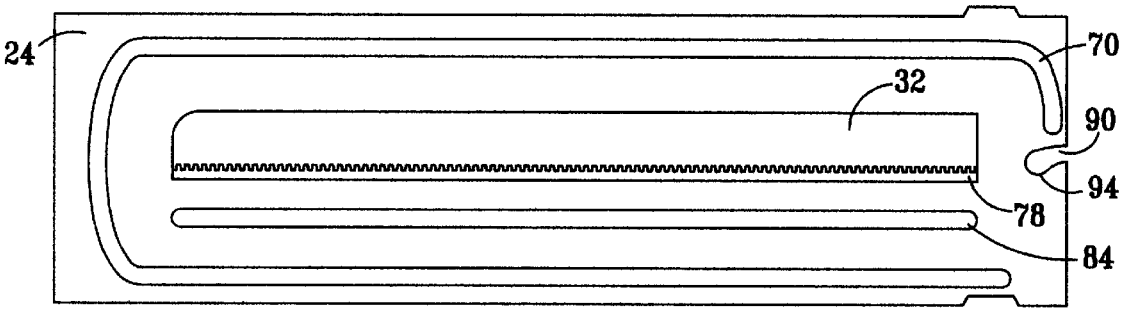
FIGS. 5 and 6 illustrate side views of the left and right panels of the cassette.
Figure 6:
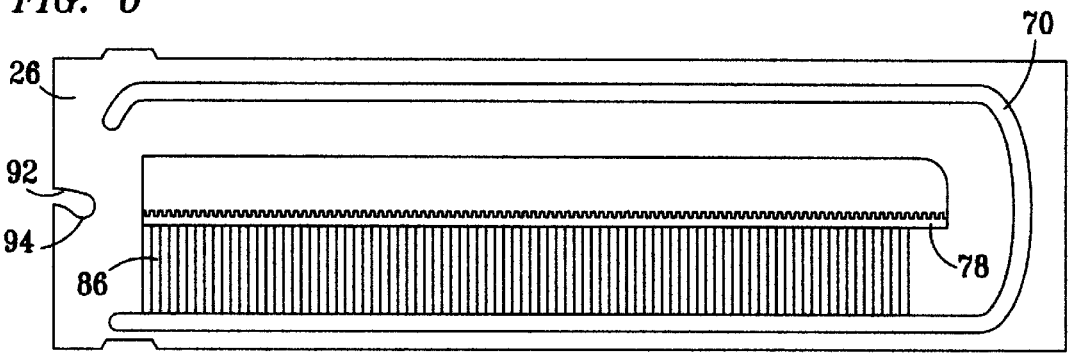

Referring now to FIGS. 5 and 6, there are illustrated side views of the left and right sides 24 and 26, respectively. Each of the left and right sides 24 and 26 have associated therewith a rack 78 with a surface extending upward. Each of these racks 78 is operable to interface with a toothed gear 80, as shown in FIG. 4. The left side 24 has disposed below the rack 78 a horizontal slot 84 that runs along the length of the rack 78, whereas the right side 26 has disposed below the rack 78 a plurality of vertical slots 86. The horizontal slot 84 is a guide slot for the compression panel 38, whereas the vertical slots 86 are locking slots, as will be described hereinbelow. In addition, each of the sides 24 and 26 has disposed in the open end thereof a slot 90 and a slot 92, respectively, with each of the slots 90 and 92 having a detent 94 associated therewith. The detent 94 is operable to receive a pan head pin 96 on the right side of the door 30, the slot 90 operable to receive a similar pan head pin (not shown). The door 30, as will be described hereinbelow, is operable to reciprocate vertically in the closed position, such that the pin 96 can reciprocate downward into the detent 94. The left and right sides 24 and 26 are fabricated from a plastic material and the pan head pin 96 extends outward over the edge of the slot 90, it being a large diameter, such that it will prevent an individual from prying the sides 24 and 26 apart, gaining entrance thereto and then placing them back together. As will be described hereinbelow, when the door 28 is closed, it overlaps the door 30, preventing it from reciprocating upward and the pan head pin 96 rotating out of the slot 92.

Figure 7:
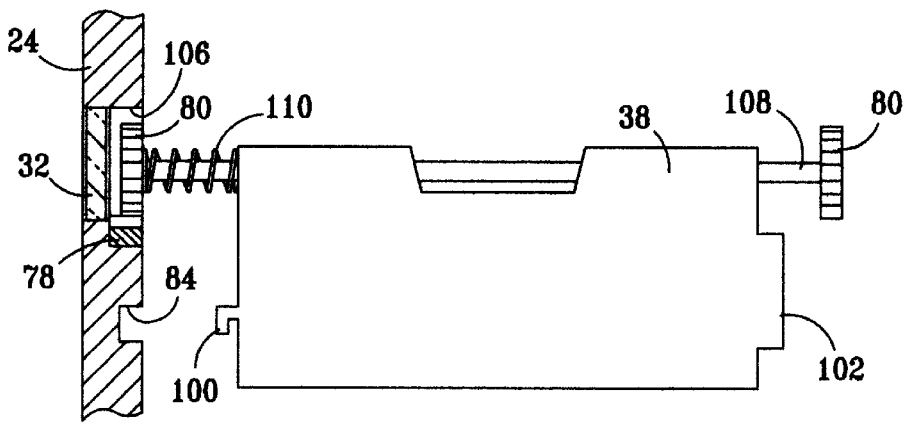
FIG. 7 illustrates an end view of the internal compression plate in the cassette.

Referring now to FIG. 7, there is illustrated an end view of the compression panel 38. The compression panel 38 is manufactured of a flat metal sheet having disposed on one side thereof a guide pin 100, proximate to the left side 24 and, on the other side thereof, a protrusion 102. The guide pin 100 is operable to be disposed within the guide slot 84 and the protrusion 102 is operable to fit within each of the slots 86 on the right side 26. The gears 80 are operable to be disposed within a slot 106 that has the rack 78 disposed therein and is proximate to the transparent window 32. Only the left side 24 is illustrated. The gears 80 are connected together through a shaft 108, the gears 80 fixedly attached to the shaft 108. In this manner, both gears 80 on either end of the shaft 108 are co-rotatable. The compression panel 38 is slidingly engaged with the shaft 108, such that it can slide in either direction and pivot about the shaft 108. A spring 110 is disposed between the edge of the compression panel 38 and the gear 80 proximate to the left side 24, such that the panel 38 is urged away from the guide slot 84.

In order to move the panel 38, the panel 38 is urged toward the slot 84, such that the guide pin 100 will be inserted in the slot 84. As this happens, the protrusion 102 is moved away from the right side 26 and the slots 86, thus allowing the panel 38 to be urged along the length of the cassette. When the panel 38 is at the appropriate position, the panel 38 is allowed to be moved away from the left side 24 and toward the right side 26 by the spring 110, such that the protrusion 102 will be inserted into one of the slots 86. Typically, this requires some manual manipulation.

The purpose for the fixed configuration of the shaft 108 and the two gears 80 is to prevent the panel 38 from skewing relative to a perpendicular orientation along the path of travel. Therefore, when the panel 38 is urged along the length of the cassette 20, both gears 80 must rotate and maintain a perpendicular orientation.

Figure 8:
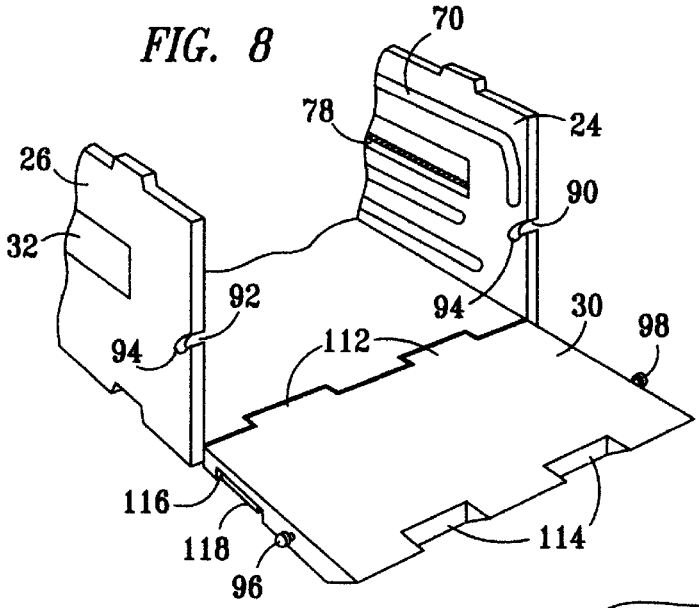
FIG. 8 illustrates an end view of the cassette with the door open.

Referring now to FIG. 8, there is illustrated a detail of the open end showing the door 30 in an open position. The door 30 has associated with the left side a pan head pin 98 for interfacing with the slot 90. The door 30 is operable to rotate about hinges 112, which hinges 112 are asymmetrical, i.e., they are not round. This allows the door 30 to reciprocate in the planar surface thereof. This will allow the door 30 to reciprocate outward away from the pivoting area of the hinges 112, such that the narrow portion of the pan head pins 96 and 98 can insert in the slots 92 and 90, respectively, and then down into the detents 94. On the outermost edge of the door 30, there are provided two slots 114. The slots 114 are operable to interface with corresponding protrusions (not shown) on the docking station.

Figure 9:
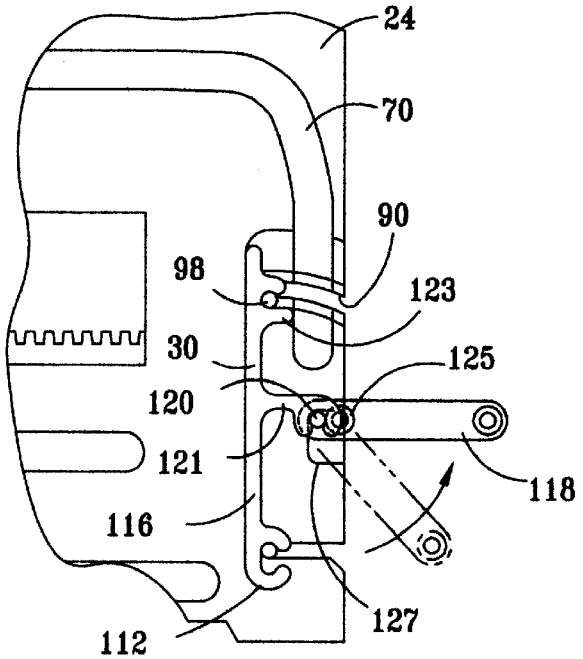
FIG. 9 illustrates a side view of the door with the handle extended.

Referring now to FIG. 9, there is illustrated a side view of the door 30 in a closed position. The door 30 has a recess area 116 on the outer surface thereof which is operable to contain a handle 118. The handle 118 is operable to rotate about a pivot point 120 away from the recess area 116 and extend outward, as illustrated in FIG. 9. This allows the cassette 20 to be picked up. The pivot point 120 is disposed on a vertical protrusion 121 that extends outward from the door 30. A second protrusion 123 is also provided proximate to the end of the door 30 and having a lower height than the protrusion 121. The handle 118 has a pin 125 disposed thereon proximate to the pivot point 120 and slightly outward therefrom. The pin 125 is operable to fit within a recess 127 when the door 30 is closed. When the handle 118 is swung outward from the recess 116, the pin 125 contacts the upper surface of the recess 127 and forces the door 30 downward, such that the pin 98 is forced down into the detent 94. The two perpendicular protrusions 121 and 123 on the surface of the door 30 with the end of the door 28 (not shown) provide an overlap. The protrusions 121 and 123 prevent a would-be thief from slipping a note around the interface between the door 30 and the door 28.

Figure 10:
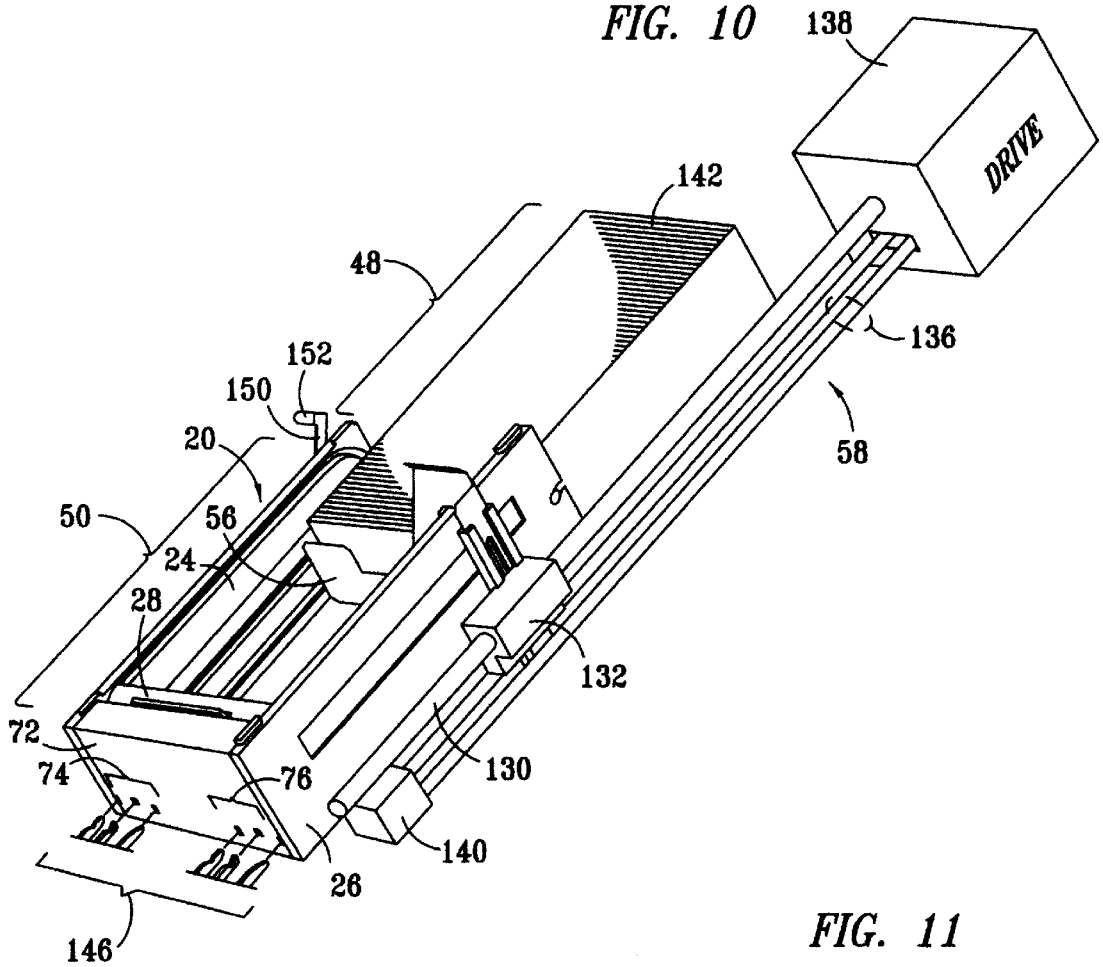
FIG. 10 illustrates a detail of the feeder docking station.

Referring now to FIG. 10, there is illustrated a detail of the feeder docking station. At the feeder docking station, the cassette 20 is disposed in the cassette region 50 just below the buffer region 48. As noted above, the buffer region 48 is approximately equal to the length of the cassette region 50. The feeder mechanism 58 is comprised of a rod 130 that runs along the length of the feeder docking station. A reciprocating device 132 is disposed on the rod 130 and is attached to the paddle 56. The paddle 56 is operable to extend up over the right side 26 of the cassette 20. The reciprocating device 132 is interfaced with a chain 136, the chain constituting a part of the chain drive which is driven by a chain drive mechanism 138 on one end, the upper end, and a pulley mechanism 140 at the opposite end. The chain 136 moves in one direction. The reciprocating mechanism 132 has a release lever associated therewith (not shown) to allow it to be released. This is conventional in a sorter mechanism. Therefore, the reciprocating device 132 can be manually pulled down to a position beneath a group of notes 142.

As noted above, the cassette 20 is disposed in the feeder docking station after a previous cassette has been in the feeder docking station a sufficient amount of time for the paddle 56 to have been reciprocated upward and out of the cassette 20. When the new cassette 20 is disposed in the docking station, the end thereof is interfaced with a plurality of keys 146 that interface with the key slots 74 and 76. Once in the feeder docking station, the door 28 can be opened and door 30 then swiveled outward from the open end. At this point, the paddle 56 is at a location that is higher in the feeder docking station than the open end of the cassette 20. Since a typical cassette holds approximately 2,000 notes, there will be approximately 2,000 notes in the buffer region 48 when a cassette 20 is removed. At a feed rate of 1,500 notes per minute, it requires that a new cassette be disposed in the feeder docking station within less than approximately 1.5 minutes. Since the paddle 56 is reciprocating upward, the notes in the cassette 20 must be urged upward to contact the notes in the buffer region 50 and then the paddle 56 disposed behind the combined groups of notes. This can be done by two methods. In the first method, the user can push the notes in the buffer region upward to maintain a constant pressure thereon and then tilt the paddle 56 by rotating it after releasing it from the chain drive and then sliding it down the rod 130 to a point behind the notes in the cassette 20. The paddle 56 can then be utilized to slide the notes upward until they contact the notes in the buffer region 50, at which time the paddle 56 is then re-engaged with the chain drive. A second method is to urge the notes in the cassette upward from the cassette 20 to contact the back of the paddle 56, this being a manual operation. Thereafter, the user can hold these notes in place, rotate the paddle 56 upward and then place it behind the combined notes in the cassette and the ones previously in the buffer region 48. Thereafter, the operator waits for the notes to be urged completely out of the cassette 20 and then a new cassette placed in the feeder docking station. This is therefore a continuous and seamless operation to the sorter. In order to insure that the operation is continuous, the drive mechanism 138 provides a constant pressure on the notes. This is facilitated through the use of a pressure switch (not shown), which prevents too much pressure being placed on the notes with the paddle 56 or a direct drive motor. Either method is acceptable.

In order to facilitate removal of the cassette 20, a removal lever 150 is provided having an actuating arm 152. The actuating arm 152 is operable to be actuated and to cause the door 30 (not shown) to be urged upward, allowing the user to then complete door closing.

Figure 11:
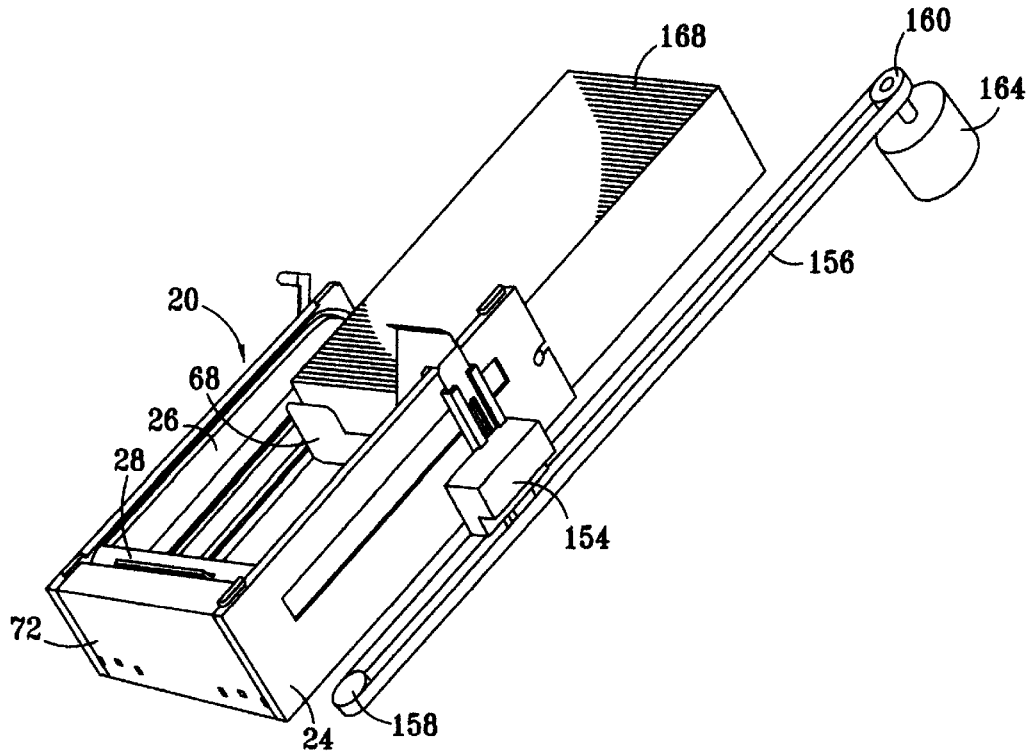
FIG. 11 illustrates a perspective view of the cassette disposed in the collection docking station.

Referring now to FIG. 11, there is illustrated a perspective view of the cassette 20 disposed in the collection docking station. The collection docking station is substantially similar to the feeder docking station, with the exception that it operates in the reverse end that it does not have as large a buffer region. The buffer region is approximately 6 inches, less than the length of a cassette 20. In this mechanism, the paddle 68 is reciprocated along a rod (not shown) similar to the rod 130 in FIG. 10. A reciprocating block 154 is provided which is operable to reciprocate along this rod (not shown). The reciprocating block 154 is interfaced with an engaging member that contacts the side of a toothed belt 156, the toothed belt 156 being disposed on an idler pulley 158, that is toothed, and to a toothed drive pulley 160 on the other end. Drive pulley 160 is driven by a belt drive motor 164. The blade 68 is operable to reciprocate upward a sufficient vertical distance to clear notes 168 that are disposed in the collection docking station. The paddle 68 can then be disengaged with the belt 56 and reciprocated to a desired position.

The operation is such that notes, after the sorting operation, are routed to the particular collection docking station in which the cassette 20 resides and are, via gravity, disposed therein. The surface of the collection docking station is at approximately a forty five degree angle. When the paddle is reciprocated up to the closest position to the sorting mechanism, the notes will be disposed in the sorter and, in response to notes coming into the particular collection docking station, the belt drive motor 164 will increment the belt 156 and reciprocate the paddle 68 down toward the lower end of the collection docking station, which is also the closed end of the cassette 20, when the cassette 20 is disposed in the collection docking station. As will be described hereinbelow, there are sensors that sense when the paddle 68 approaches the cassette 20 and, a switch associated with the cassette 20 being in place will be sensed. If this switch is set, indicating a cassette 20 is disposed therein, the operation will continue and the blade 68 will move downward. Once a sufficient number of notes to fill the capacity of the cassette 20 have been disposed at a particular collection station, the paddle 68 will then be moved downward in the cassette 20, the paddle 68 reciprocated vertically upward and then moved all the way to the top, such that new notes coming into the collection docking station can then be disposed on the upper surface of the paddle 68. The cassette 20 can then have the door thereof closed, and then removed from the collection docking station. A new empty cassette is then disposed therein. Typically, as described above, the cassette 20 is already open. However, the locking keys (not shown) are disposed on the collection docking station to allow the cassette 20 be in an unlocked position and thereafter allow the door 28 to be slidingly moved upward for closure.

Figure 12:
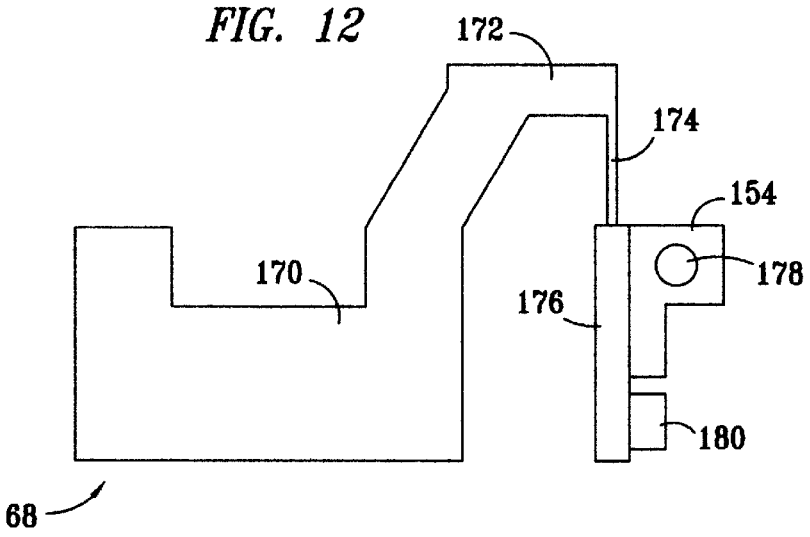
FIG. 12 illustrates a side view of the blade and the reciprocating member.

Referring now to FIG. 12, there is illustrated a side view of the paddle 68 and the reciprocating member 154. The paddle 68 has a lower flat surface 170, which contacts the notes 168. An extending arm 172 extends upward over the right side 24 of the cassette 20 and downward to a vertically reciprocating arm 174. The vertically reciprocating arm 174 reciprocates within a slide bracket 176. Slide bracket 176 is attached to the reciprocating member 154, reciprocating member 154 having a cylindrical bore 178 disposed therethrough that is operable to reciprocate along the rod that was not shown in FIG. 11 and that is similar to the rod 130 in FIG. 10. Below the reciprocating member 178 is disposed a toothed block 180, toothed block 180 shown in a side view and operable to interface with the teeth on the inside surface of the belt 156 on the outer band. Whenever it is desired to release the toothed block 180 from the belt 156, it is only necessary to pull up on the arm 172 which will rotate the toothed block 180 away from the surface of the belt 156.

Figure 13:
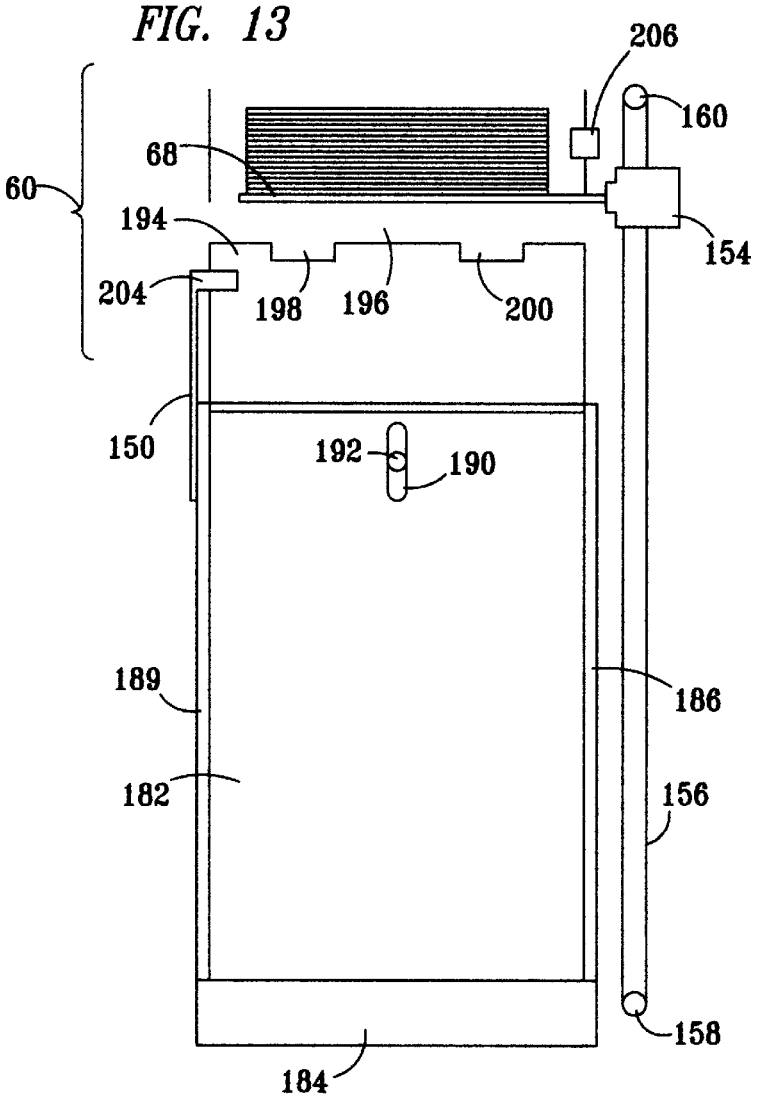
FIG. 13 illustrates a top view of the collection docking station with the cassette removed.

Referring now to FIG. 13, there is illustrated a top view of the collection docking station with the cassette 20 removed. The collection docking station has a flat plate 182 with sides 184 and 186 associated therewith, these providing a guide for the cassette 20 on either side thereof A door 184 is provided, which is substantially identical to the door 22 on the desktop docking station 16 in FIG. 2. This door 184 covers the key members 146 described above with respect to FIG. 10 and is operable to open in response to the cassette 20 being placed therein. The purpose of the door 184, as described above, is for protection and, also for a visual view to require the user to place the cassette above the door and then slide it down to open the door and insert the keys. Otherwise, the user might try to push down upon the keys 146, thus damaging the keys 146. A switch orifice 190 is provided for containing a switch 192, which switch 192 indicates the presence of the cassette 20 when the door 30 is opened. The door 30 is operable to open into a space 194 which has a plate 196 disposed on the upper end thereof. This plate 196 is raised and has two projections 198 and 200 which are operable to interface with the slots 114 and the door 30, as illustrated in FIG. 8. Therefore, the door 30 can be laid flat such that a flat surface is presented. The release lever device 150, described above with respect to FIG. 10, is disposed on the upper left side of the cassette 20 when disposed therein. An extending lever member 204 extends outward in front of the cassette 20 when installed and under the edge of the door 30, substantially under the pan head pin 98. Therefore, it is only necessary to actuate the lever 152 to raise the lever member 204 and pull the door 30 upward to allow the user to grasp this lever.

A sensor 206 is provided in the side of the buffer region 60 which is operable to sense the presence of notes on the surface of the paddle 68. The paddle 68 is reciprocated all the way up to the sorter such that it is past the sensor 206. The sensor will indicate that there are no notes past that point. Once the notes have been collected to a certain thickness, the paddle 68 will reciprocate past the sensor 206 and the sensor 206 will provide a signal to a central control system. The central control system will then determine if the switch 192 is depressed, indicating the presence of a cassette. If not, then the system will be shut down only when the paddle is not in the buffer region. If it is in the buffer region, it will continue to operate.

Figure 14:
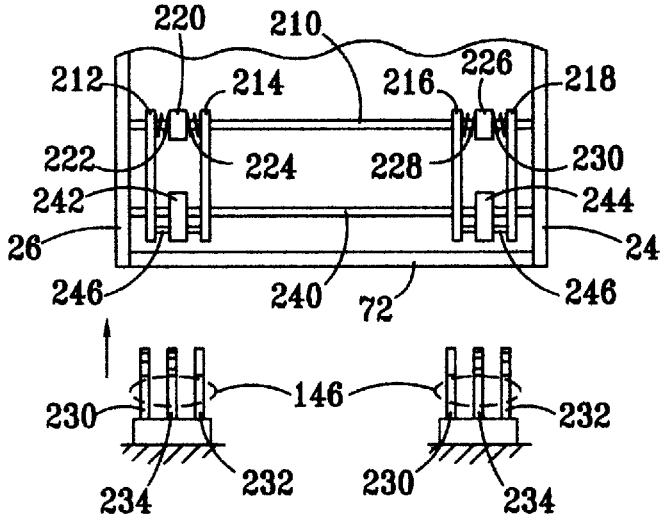
FIG. 14 illustrates a top view of the closed end of the cassette, illustrating the locking mechanism.

Referring now to FIG. 14, there is illustrated a top view of the closed end 72 of the cassette 20, illustrating the locking mechanism. A first shaft 210 extends between the left side 24 and right side 26 and has associated therewith on one side two pivoting lever members 212 and 214. On the opposite side, proximate to the right side 26, are disposed two similar pivoting lever members 216 and 218. The pivoting lever members 212 and 214 are separated by a plastic bushing 220 attached to the shaft 210 with springs 222 and 224 disposed between the block 220 and pivoting lever members 212 and 214, respectively. Similarly, a plastic block 226 is disposed between pivoting lever members 216 and 218 and separated therefrom by springs 228 and 230. The pivoting lever members 212 and 214 are disposed above the outside key access holes 74 on the left side of the end 72 and the two pivoting members 216 and 218 are each disposed against opposite ones of the outside holes on the key access hole 76. The key members 146 are comprised of two outside key members 231 and 232 and a central key member 236. The outside key members 231 and 232 of the key portion associated with the key access holes 74 are operable to engage the ends of the pivoting lever members 212 and 214. Similarly, on the key member 146 associated with the key access hole 76, the outer key members 231 and 232 are operable to pass through the outside key access holes 76 to engage the ends of the pivoting lever members 216 and 218.

A second shaft 240 is provided that is disposed between the left side 24 and the right side 26 of the cassette 20. The shaft 240 is closer to the end 72. A pivoting lever 242 is disposed on the shaft 240 to pivot thereabout and disposed between the distal ends of the pivoting lever members 212 and 214. Similarly, a pivoting lever 244 is disposed on the shaft 240 and allowed to pivot thereabout and disposed between the distal ends of the pivoting lever member 216 and 218. Disposed on each side of the pivoting members 242 are tracks (not shown}. These tracks are operable to receive pins 246 that extend outward from the associated pivoting members 212 and 214, or 216 and 218. This will be described in more in detail with respect to FIG. 15. The pivoting lever members 242 are urged upward with the center key members 236 in each of the key devices 146. As will be described hereinbelow, when the pivoting lever 242 is urged upward, it is necessary for the pivoting action of the pivoting lever members 212 and 214, and 216 and 216 to traverse the path such that the pins 246 disposed in the ends and extending outward therefrom will traverse a particular path. Therefore, there is a defined shape to each of the members 231 and 232 which will determine this path.

Figure 15:
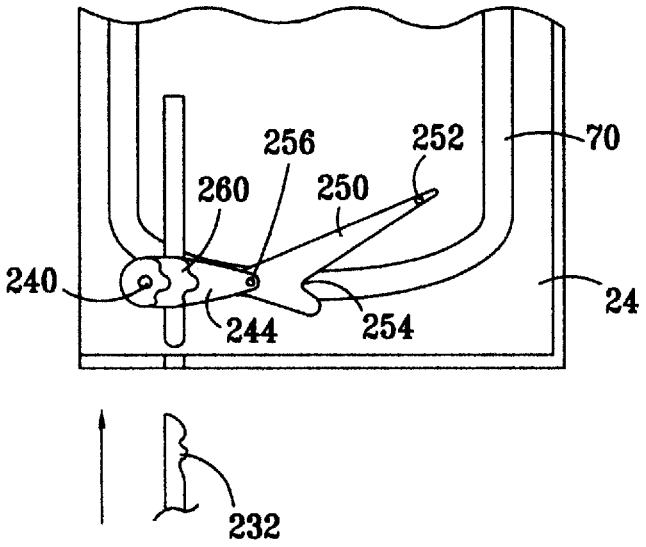
FIG. 15 illustrates a side view of a locking member.

Referring now to FIG. 15, there is illustrated a side view of a locking member looking into the side of the right side 26. There is provided a locking lever 250, which is pivoted on one end at a pivot point 252 and has a "crook" 254 on the other end thereof, this crook being at a distance from the pivot point 252, such that the crook 252 will pivot into the path 70. Whenever the door 28 slides through the guide 70 into the crook 254, the locking lever 250 rotated such that the crook 254 is in that path, this will prevent further movement. Additionally, once the door 28 is urged against the crook 254, the direction of forces is "normal" to the pivot point 252, such that the lever 250 is not stressed, the force being along the length thereof.

The lever member 244 extends outward from the shaft 240 and has a pivoting shaft 256 disposed thereon, which is pivoted about a hole in the distal end of the locking lever 250, distal from the pivoting point 252. Whenever the lever 244 is urged upward by the locking pin 234, the pivoting shaft 256 will be urged upward, pivoting the locking lever 250 about the pivot point 252 and moving the crook 254 away from the path 70, to thereby allow the door 28 to pass thereby.

The pivoting lever 244 has a track 260 formed in the side thereof that is operable to interface with the pin 246 in the lever 216. An opposite path is disposed on the opposite side to interface with the pin 246 in the pivoting lever 218. This path 260 is configured such that, as lever 244 pivots upward, the end of the pivoting lever 216 must pivot in such a manner that the pin 246 will meander along the correct path. If the shape of the key member 231 is not correct, the path will be wrong and it will fall into defined "pockets" which will prevent further movement and further pivoting of lever 244. The shape of both key members 231 and 232 must be correct in order to insure that the end of the pivoting members 216 and 218 traverse the defined path.

In summary, there has been provided a currency sorting system utilizing a cassette for transporting the currency between locations. The cassette is a secured device that has an interior with a door that can be opened to expose the entire front surface of the currency and an end that allows currency to be reciprocated out in a push operation. The cassette has a locking device for engaging with a corresponding key on a docking station, such that when the cassette is disposed on the docking station, the door will open. When removed from the docking station, and the door is closed, the door cannot be opened. The cassette is hand loaded at one docking station and then secured for movement to a second docking station that is associated with a sorting mechanism. On the sorting mechanism, it is necessary to feed the notes into the sorter input. The feeding docking station is approximately twice the length of the cassette with a cassette region and a buffer region. A paddle is utilized to extend downward into the cassette to urge the notes up into the buffer region. Once the notes are in the buffer region, the cassette can be removed and another cassette disposed therein and the paddle again moved into the cassette to urge the notes outward in a continuous motion. When the cassette is removed, it is then disposed in a third collection docking station in a collection slot. The collection slot is associated with a sorter output wherein notes that are sorted are disposed in particular ones of the collection docking stations. A paddle is provided in this station that reciprocates downward into the cassette as notes are disposed in that particular docking station. When the cassette is full, it can then be removed.

Although the preferred embodiment has been described in detail, it should be understood that various changes, substitutions and alterations can be made therein without departing from the spirit and scope of the invention as defined by the appended claims.

What is claimed is:

1. An apparatus for feeding documents from a plurality of portable cassettes to a receiving system, each of the cassettes having a stack of documents contained therein, comprising:

a docking station for receiving each of the cassettes such that the cassettes are arranged along the length thereof;

a buffer region for being disposed proximate to the docking station and between the docking station and the receiving system;

a feeding mechanism for urging the stack of documents from the cassette when disposed in the docking station and outward into the said buffer region and toward the receiving system, the cassette having a door disposed thereon that is operable to open and expose at least the end of the stack of documents in the cassette when the cassette is disposed on said docking station; and said feeder mechanism operable to continuously feed the stack of documents in said buffer region when a cassette is removed from said docking station, and feed the stack of documents toward the receiving system, and said feeder mechanism operable to be altered in operation to urge the stack of documents from a subsequent cassette placed in said docking station to a position immediately behind any documents disposed in said buffer region from a previous cassette, such that a substantially constant pressure is maintained on the documents in the buffer region to provide a continuous movement of the documents relative to the receiving system as the cassette is placed in said docking station and the stack of documents is removed from the cassette.

2. The apparatus of claim 1, wherein said buffer region has a length that is substantially equal to or greater than the length of the cassette.

3. The apparatus of claim 1, wherein the cassette has a top opening to expose the side of the stack of documents in the cassette and wherein said feeder mechanism is operable to place a flat paddle within the cassette adjacent the end of the stack of documents opposite to the open end of the cassette and urge the stack of documents outward into said buffer region.

4. The apparatus of claim 1, wherein the cassette has a locking mechanism for locking the operation of opening and wherein said docking station has associated therewith a key mechanism, which key mechanism is operable to interface with the locking mechanism of the cassette when the cassette is disposed in said docking station by the operation of disposing the cassette in said docking station.

5. A method for feeding documents from a plurality of portable cassettes to a receiving system, each of the cassettes containing a stack of documents, comprising the steps of:

transporting the cassettes to a docking station, disposing one of the cassettes on a docking station with the stack of documents enclosed within a respective one of the cassettes in which it is loaded;

opening the one cassette to expose at least the end of the stack of documents disposed therein;

urging the stack of documents outward from the one cassette into a buffer region, while maintaining a substantially constant pressure on documents which are within the buffer region such that the receiving system is operable to continuously remove documents from the other end of the buffer region;

after urging the stack of documents outward from the one cassette, continuing to urge the stack of documents upward in the buffer region toward the receiving system and then removing the one cassette; and disposing another of the cassettes in the docking station after removal of the previous one of the cassettes and repeating the operation of opening, urging and removing, such that a continuous supply of documents is maintained within the buffer region and able to continuously move through the buffer region during the steps of disposing, urging and removing.

6. The method of claim 5, wherein the step of opening the one cassette is operable to expose the top of the one cassette and the side of the stack of documents.

7. The method of claim 5, wherein the buffer region has a length approximately equal to or exceeding the length of the cassettes.

8. The method of claim 5, wherein each of the cassettes has a locking mechanism disposed thereon and the docking station has a key mechanism disposed thereon and, wherein the step of disposing the one cassette on the docking station is operable to interface the locking mechanism with the key mechanism and unlock the one cassette to allow the interior of the one cassette to be exposed to an operator in the step of opening, and the step of opening is inhibited when the one cassette is not in the docking station and the one cassette is in a locked configuration.

* * * * *